US008948412B2

(12) United States Patent
Lee et al.

(10) Patent No.: US 8,948,412 B2
(45) Date of Patent: Feb. 3, 2015

(54) AUTOMATIC DETECTION OF THE WEARING STYLE OF A CONVERTIBLE HEADSET

(75) Inventors: Barry Lee, Santa Cruz, CA (US); Ching Shyu, San Jose, CA (US)

(73) Assignee: Plantronics, Inc., Santa Cruz, CA (US)

( * ) Notice: Subject to any disclaimer, the term of this patent is extended or adjusted under 35 U.S.C. 154(b) by 460 days.

(21) Appl. No.: 12/911,611

(22) Filed: Oct. 25, 2010

(65) Prior Publication Data

US 2012/0099738 A1 Apr. 26, 2012

(51) Int. Cl.
*H04R 1/10* (2006.01)

(52) U.S. Cl.
CPC ..... *H04R 1/105* (2013.01)
USPC ..... 381/74; 381/375

(58) Field of Classification Search
USPC ..... 381/74, 370–384, 366–367; 379/420.01, 420.04
See application file for complete search history.

(56) References Cited

U.S. PATENT DOCUMENTS

| | | | | |
|---|---|---|---|---|
| 5,708,724 | A * | 1/1998 | Burris et al. | 381/370 |
| 8,335,334 | B1 | 12/2012 | Rosas et al. | |
| 2008/0298622 | A1 * | 12/2008 | Lee | 381/378 |
| 2009/0268935 | A1 * | 10/2009 | Dillinger | 381/371 |
| 2010/0020998 | A1 * | 1/2010 | Brown et al. | 381/380 |
| 2010/0142738 | A1 * | 6/2010 | Zhang et al. | 381/315 |

* cited by examiner

*Primary Examiner* — Ahmad F Matar
*Assistant Examiner* — Katherine Faley
(74) *Attorney, Agent, or Firm* — Michael D. Rodriguez

(57) ABSTRACT

A system for adjusting an audio setting for a headset, comprises a communications device, a detachable headband containing a detectable element that can be coupled to the communications device, a sensor coupled to the communications device configured to determine whether the headband is coupled to the communications device and a processor configured to adjust the audio setting for the headset to a headband mode when the headband is coupled to the communications device. The processor may also adjust the audio setting of the headset to a non-headband mode based on the sensor detecting the headband being disconnected from the communications device.

20 Claims, 7 Drawing Sheets

AUTOMATIC DETECTION OF THE WEARING STYLE OF A CONVERTIBLE HEADSET

FIELD OF INVENTION

The present invention relates to communications headsets, and more particularly, to a system and method for adjusting an audio setting of a communications headset.

BACKGROUND OF THE INVENTION

Communications headsets can be used in a diversity of applications and are particularly effective for telephone operators, office administrators, and other individuals whom it is desirable to have "hands free" operation of communication systems.

Monaural headsets are communications headsets which have only a single audio receiver situated near one ear. Monaural headsets may be worn in either one of two styles, over the ear with an ear bud and ear loop or headband with an ear cushion.

SUMMARY OF THE INVENTION

According to one embodiment of the invention, a system for adjusting an audio setting for a headset, comprises a communications device, a detachable headband that can be coupled to the communications device, a sensor coupled to the communications device configured to determine whether the headband is coupled to the communications device and a processor configured to adjust the audio setting for the headset to a headband mode when the headband is coupled to the communications device. The processor may also adjust the audio setting of the headset to a non-headband mode based on the sensor detecting the headband being disconnected from the communications device. The headband may comprise at least one ear cushion, and the sensor may be a Hall Effect Sensor or a reed switch. Further, a magnet may be coupled to the headband to trigger the sensor and the communications device may comprise a wireless communications transceiver. The audio setting may also be a receive volume setting, a receive frequency response setting, a terminal coupling loss weighted setting, a side tone setting, a receive noise reduction setting, or a receive automatic level control setting.

In another embodiment of the invention, a method of adjusting an audio setting for a headset comprises receiving data from a sensor coupled to the headset indicating a connection between a detachable headband and the headset and providing a first output signal to adjust the audio setting for the headset based on the connection of the detachable headband to the headset. The method may further provide detecting by the sensor that the headband and the headset have become disconnected and second output signal to adjust the audio setting of the headset based on the headband being disconnected from the headset. The headband may have at least one ear cushion and the sensor may be a Hall Effect Sensor or a reed switch. Further, a magnet may be coupled to the headband and configured to trigger the sensor when the connection has been made. The communications device may also comprise a wireless communications transceiver. The audio setting may also be a receive volume setting, a receive frequency response setting, a terminal coupling loss weighted setting, a side tone setting, a receive noise reduction setting, or a receive automatic level control setting.

In another embodiment of the invention, the headset comprises a detachable headband, a communications device coupled to the headband, a sensor coupled to the communications device and configured to detect a connection state between the communications device and the headband and a processor operably coupled to the sensor to adjust a setting of an audio equalizer to a headband mode from a non-head band mode when the sensor detects that the headband state has become connected to the communications device. The headset may further comprise adjusting the setting of the audio equalizer to a non-headband mode from a headband mode when the sensor detects that the headband state has become disconnected from the communications device. The headband may be detached and replaced with an ear bud and ear loop for supporting the communications device on a user's ear. The headband may also comprise of one ear cushion. The communications device may comprise a speaker for providing audio to a user's ear, a microphone, and an audio equalizer. The sensor may be a Hall Effect Sensor or a reed switch. Further, a magnet may be coupled to the headband to trigger the sensor and the communications device may comprise a wireless communications transceiver. The setting of the audio equalizer may be a receive volume setting, a receive frequency response setting, a terminal coupling loss weighted setting, a side tone setting, a receive noise reduction setting, or a receive automatic level control setting.

DETAILED DESCRIPTION OF THE DRAWINGS

Systems, methods, and apparatuses for adjusting the audio setting of a communications headset are disclosed. The following description is presented to enable an ordinarily skilled person in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For the purpose of clarity, material that is known in the technical fields related to the invention have not been described in detail so as not to unnecessarily obscure the present invention.

Monaural headsets have their limitations with respect to audio quality because the audio settings for the best audio quality for an over the ear wearing style are not the same as for a headband with an ear cushion wearing style. Therefore, users of such monaural headsets only receive the best audio quality for one of the two wearing styles. As a result, improved apparatuses and methods for changing the audio settings from an over the ear wearing style to a headband with ear cushion wearing style or vice versa are needed.

Figure 1:
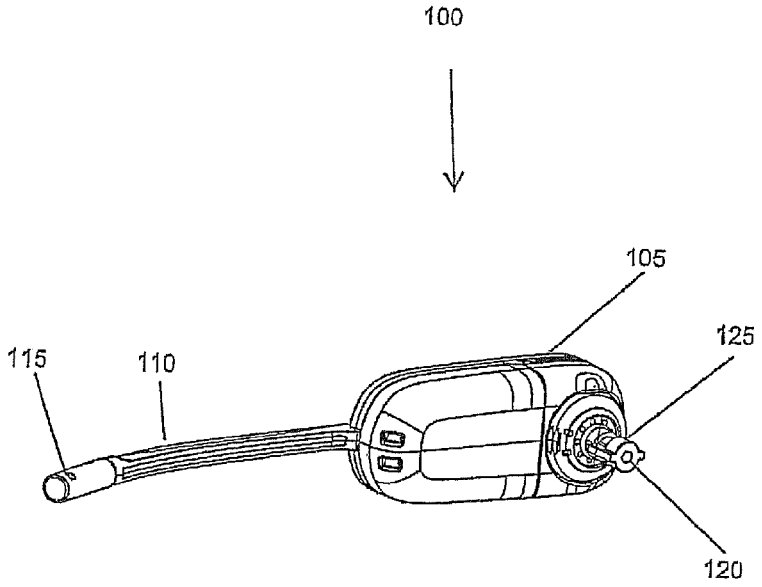
FIG. 1 illustrates a left side perspective view of a communications device 100, according to an embodiment of the invention.

FIG. 1 illustrates a communications device 100, according to one embodiment of the invention. The communications device 100 comprises a body 105, a boom 110, a microphone 115, a speaker port 120 and an attachment post 125.

The communications device 100 provides audio signals to a user's ear. The communications device 100 includes an audio driver (not shown) to convert an audio signal, received via cord or wirelessly, to an audible output via the speaker port 120. The communications device also includes a boom 110 and a microphone 115 located in the tip of the boom 110. The microphone 115 may comprise a noise cancelling microphone, for example. The communications device 100 also includes an attachment post 125 for attaching the communication device 100 to a headband (such as headband 300 shown in FIG. 3A) or an ear bud and ear loop (such as ear bud 405 and ear loop 415 shown in FIG. 4). A sensor 205 (see FIG. 2) located in the communications device 100 can change the audio setting to a headband mode when the headband 300 is attached or to a non-headband mode when the headband 300 is detached.

Figure 2:
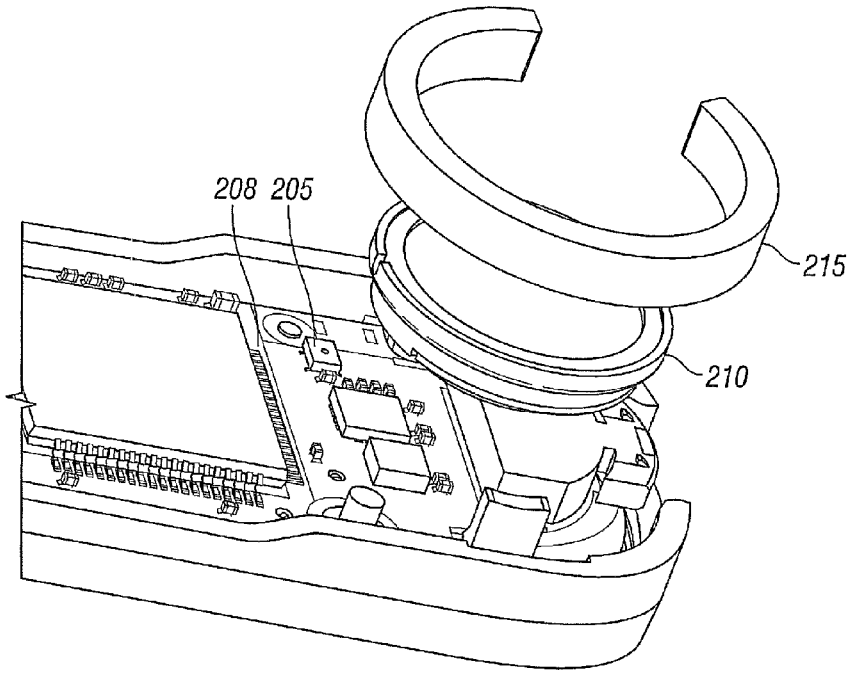
FIG. 2 illustrates a cut away view of the communications device 100 shown in FIG. 1, according to an embodiment of the invention.

FIG. 2 shows a cut away view of the communications device 100, according to one embodiment of the invention. The communications device 100 comprises a sensor 205 and a speaker 210. Also shown is a C magnet 215 which is located in the headband boss of the headband 300 (not shown).

The sensor 205 may be coupled to a printed circuit board 208 which includes a processor (such as processor 600 shown in FIG. 6) for receiving signals from the sensor 205.

The sensor 205 may be a reed switch or a Hall Effect Sensor which is a transducer that varies its output voltage in response to changes in magnetic field, according to an embodiment of the invention.

The C magnet 215 allows the communications device 100 to rotate 300 degrees while attached to the headband 300 and not have the sensor 205 go out of range of the magnet 215. A ring magnet or a number of cube magnets arranged in a loop may be placed in the headband boss of the headband to accomplish a similar result, according to an embodiment of the invention. With one of these types of magnets used in the headband boss, the sensor 205 remains at a detectable distance from the magnet 215 regardless of the rotational position of the communication device 100.

Figure 3A:
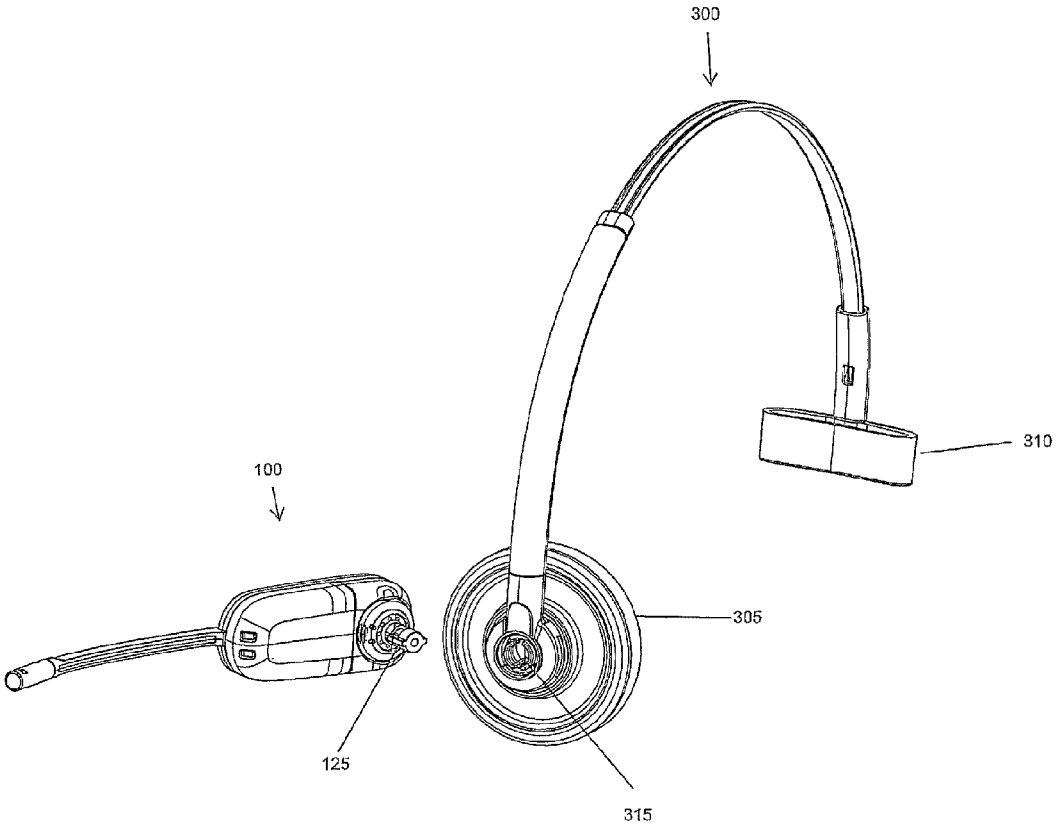
FIG. 3A provides an exploded view of the communications device 100 shown in FIG. 1 and of a headband 300, according to an embodiment of the invention.

FIG. 3A shows the communication device 100 and a headband 300, according to one embodiment of the invention. The headband 300 comprises an ear cushion 305, a pad 310, a headband attachment recess 315 and a magnet 215 (not shown, See FIG. 2).

The attachment post 125 of the communication device 100 can be attached to the headband 300 at the headband attachment recess 315. The attachment post 125 attaches to the headband attachment recess 315 of the headband 300 by a bayonet locking mechanism, according to an embodiment of the invention. Once the communications device 100 is attached to the headband 300, a sensor (such as sensor 205 shown in FIG. 2) located in the communications device 100 senses a magnet (such as magnet 215 shown in FIG. 2) located in the headband 300 and signals a processor (such as processor 600 shown in FIG. 6) coupled to the communications device 100 to adjust an audio setting of the communications device 100 to a headband mode. The headband mode audio setting is a setting optimized for the headband wearing style.

Figure 3C:
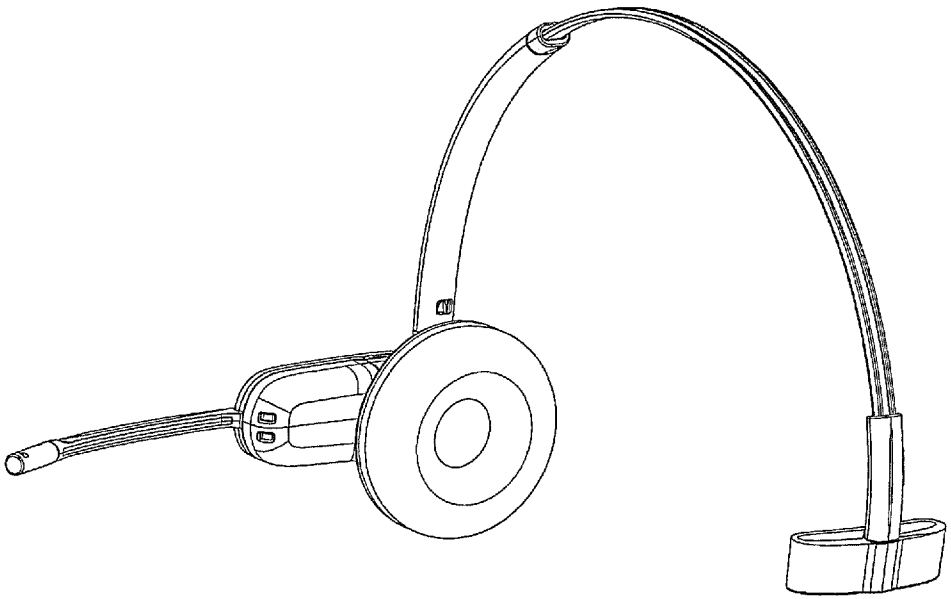
FIG. 3C illustrates a left side view of the communications device 100 and the headband 300 shown in FIG. 3B.
Figure 3B:
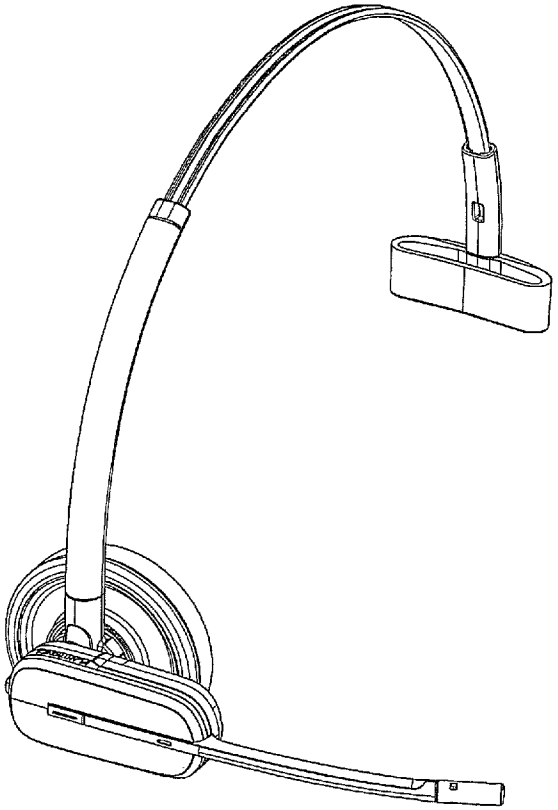
FIG. 3B illustrates a right side view of the communications device 100 and the headband 300 assembled, according to one embodiment of the invention.

Once attached together as shown in FIGS. 3B and 3C, the communications device 100 and headband 300 act as a conventional headset with a headband and fits over a user's ear and head. The pad 310 is biased towards the ear cushion 305 and allows the communications device 100 and headband 300 to be supported on a user's ear and head. While attached in the headband attachment recess 315, the attachment post 125 allows the communications device 100 to pivot approximately 300 degrees so the user may find the most comfortable wearing position and still maintain a correct boom 110 orientation, according to an embodiment of the invention.

Figure 4:
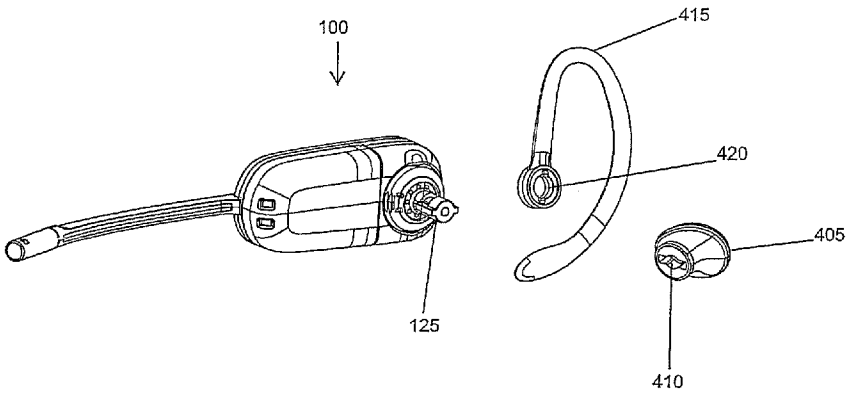
FIG. 4 illustrates an exploded view of the communications device 100, an ear loop 415 and an ear bud 405, according to an embodiment of the invention.

FIG. 4 provides an exploded view of the communications device 100, an ear bud 405, an ear bud attachment recess 410 and an ear loop 415, according to one embodiment of the invention.

The ear loop 415 which comprises an ear loop attachment point 420 attaches to the attachment post 125 of the communication device 100 at the ear loop attachment point 420. Once the ear loop 415 is attached to the communications device 100, the ear bud 405 is attached to the attachment post 125 at the ear bud attachment recess 410. The attachment post 125 attaches to the ear bud attachment recess 410 and securely holds the ear loop 415 and ear bud 405 in place by a bayonet-type locking mechanism. Other locking mechanisms could be employed within the spirit of the invention.

Once the communications device 100 is converted from being attached to the headband 300 to the ear loop 415 and the ear bud 405, the sensor 205 (See FIG. 2) no longer senses a magnet (see the magnet 215 shown in FIG. 2) located in the headband 300 and signals the processor coupled to the communications device 100 to adjust the audio setting of the communications device 100 to a non-headband mode. The non-headband mode audio setting is a setting optimized for the ear bud 405 and ear loop 415 wearing style.

Figure 5:
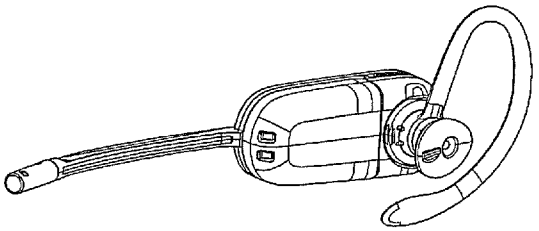
FIG. 5 illustrates a left side view of the communications device 100, ear loop 415 and ear bud 405 assembled, according to an embodiment of the invention.

Once attached together as shown in FIG. 5, the communications device 100, ear loop 415 and ear bud 405 acts as a conventional headset with an ear loop and fits over a user's ear. The ear loop 415 allows the communications device 100 with the ear bud 405 to be supported on a user's ear. While attached in the ear bud attachment recess 410, the attachment post 125 allows the communications device 100 to pivot approximately 300 degrees so the user may find the most comfortable wearing position and still maintain a correct boom 110 orientation, according to an embodiment of the invention.

Figure 6:
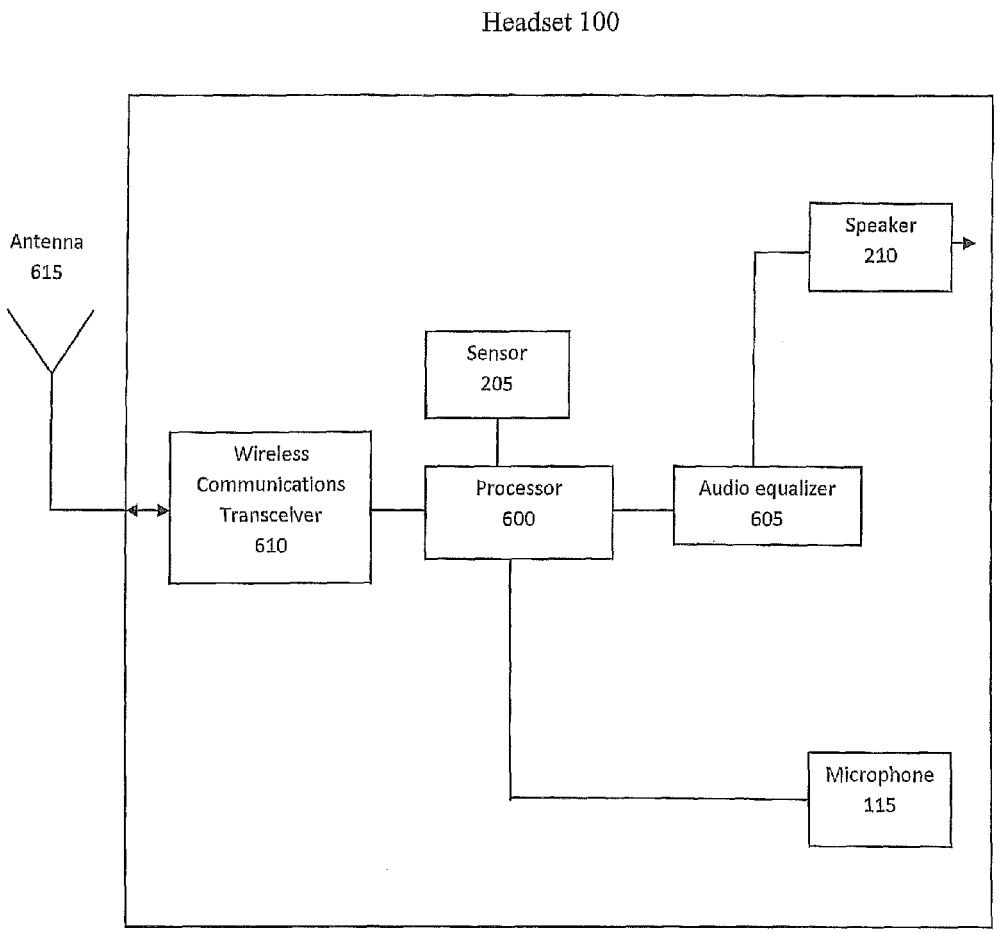
FIG. 6 is a simplified block diagram of the communications device 100, according to an embodiment of the invention.

FIG. 6 is a simplified block diagram of headset 100, according to one embodiment of the invention. The communications device 100 comprises an antenna 615, a wireless communications transceiver 610, a processor 600, a sensor 205, an audio equalizer 605, a microphone 115 and a speaker 210.

The communications device 100 provides automatic adjusted audio signals to a user's ear. The communications device 100 includes a wireless communications transceiver for receiving an audio signal wirelessly. The communications device also includes a processor 600 for adjusting the settings in the audio equalizer 605 to a headband mode or a non headband mode when it receives signals from the sensor 205. The settings adjusted in the audio equalizer may be a receive volume setting, a receive frequency response setting, a terminal coupling loss weighted setting, a side tone setting, a receive noise reduction setting, or a receive automatic level control setting.

The adjusted audio signal from the audio equalizer 605 is outputted through speaker 210 to the user's ear.

Although the present invention has been described with reference to specific embodiments thereof, these embodiments are merely illustrative, and not restrictive of the present invention. Various modifications or changes to the specifically disclosed exemplary embodiments will be suggested to persons skilled in the art. In summary, the scope of the invention should not be restricted to the specific exemplary embodiments disclosed herein, and all modifications that are readily suggested to those of ordinary skill in the art should be included within the spirit and scope of the invention.

What is claimed is:

1. A system for adjusting an audio setting for a headset, comprising:

a communications device;

a detachable headband operable to be worn over a user head, wherein the detachable headband can be coupled to the communications device;

a sensor coupled to the communications device configured to determine a detachable headband connection state comprising a coupled state indicating the detachable headband is coupled to the communications device and a decoupled state indicating the detachable headband is decoupled from the communications device; and a processor configured to adjust the audio setting for the headset to a headband mode responsive to detection of a change in the detachable headband connection state from the decoupled state to the coupled state, wherein the audio setting comprises a receive volume setting, a receive frequency response setting, a terminal coupling loss weighted setting, a side tone setting, a receive noise reduction setting, or a receive automatic level control setting.

2. The system of claim 1, wherein the processor is further configured to adjust the audio setting of the headset to a non-headband mode responsive to detection of a change in the detachable headband connection state from the coupled state to the decoupled state.

3. The system of claim 1, wherein the detachable headband comprises at least one ear cushion.

4. The system of claim 1, wherein the sensor is a Hall Effect sensor.

5. The system of claim 4, further comprises a magnet coupled to the detachable headband to trigger the sensor.

6. The system of claim 1, wherein the sensor is a reed switch.

7. A method of adjusting an audio setting for a headset, comprising:

receiving data from a sensor coupled to the headset indicating a connection status between a detachable headband and the headset; and providing a first output signal to adjust the audio setting for the headset responsive to detecting a change in the connection status of the detachable headband to the headset, the audio setting comprising a receive volume setting, a receive frequency response setting, a terminal coupling loss weighted setting, a side tone setting, a receive noise reduction setting, or a receive automatic level control setting.

8. The method of claim 7, further comprising:

detecting by the sensor that the detachable headband and the headset have become disconnected; and providing a second output signal to adjust the audio setting of the headset based on the detachable headband being disconnected from the headset.

9. The method of claim 7, wherein the detachable headband comprises at least one ear cushion.

10. The method of claim 7, wherein the sensor is a Hall Effect sensor.

11. The method of claim 7, wherein the sensor is a reed switch.

12. The method of claim 7, wherein the detachable headband contains a magnet configured to trigger the sensor when the connection has been made.

13. A headset system comprising:

a detachable headband;

a detachable earbud;

a communications device coupled to the detachable headband, wherein the detachable earbud is configured to be coupled to the communications device in a non-headband mode when the detachable headband is decoupled from the communications device;

a sensor coupled to the communications device and configured to detect a connection state between the communications device and the detachable headband; and a processor operably coupled to the sensor to adjust a setting of an audio equalizer to a headband mode from the non-headband mode when the sensor detects that the detachable headband has become connected to the communications device.

14. The headset of claim 13, wherein the processor further comprises adjusting the setting of the audio equalizer to the non-headband mode from the headband mode when the sensor detects that the detachable headband state has become disconnected from the communications device.

15. The headset of claim 13, wherein the detachable headband comprises one ear cushion arranged to be worn on a same ear as the communications device.

16. The headset of claim 13, wherein the communications device comprises: a speaker for providing audio directly to a user's ear;

a microphone; and the audio equalizer.

17. The headset of claim 13, wherein the sensor is a Hall Effect sensor.

18. The headset of claim 13, wherein the sensor is a reed switch.

19. The headset of claim 13, wherein the detachable headband contains a magnet to trigger the sensor.

20. The headset of claim 13, wherein the setting adjusted in the audio equalizer is a receive volume setting, a receive frequency response setting, a terminal coupling loss weighted setting, a side tone setting, a receive noise reduction setting, or a receive automatic level control setting.

* * * * *